US007832346B2

(12) United States Patent
Hattori

(10) Patent No.: US 7,832,346 B2
(45) Date of Patent: Nov. 16, 2010

(54) MULTI-NEEDLE TYPE EMBROIDERY SEWING MACHINE

(75) Inventor: Osamu Hattori, Ichinomiya (JP)

(73) Assignee: Kabushikikaisha Barudan, Aichi-ken (JP)

( * ) Notice: Subject to any disclaimer, the term of this patent is extended or adjusted under 35 U.S.C. 154(b) by 709 days.

(21) Appl. No.: 11/819,435

(22) Filed: Jun. 27, 2007

(65) Prior Publication Data

US 2008/0223272 A1 Sep. 18, 2008

(30) Foreign Application Priority Data

Mar. 12, 2007 (JP) ..... 2007-061685

(51) Int. Cl.
*D05B 79/00* (2006.01)
*D05B 3/00* (2006.01)

(52) U.S. Cl. ..... 112/78; 112/163; 362/90

(58) Field of Classification Search ..... 112/78, 112/220, 221, 163
See application file for complete search history.

(56) References Cited

U.S. PATENT DOCUMENTS 6,732,668 B2 * 5/2004 Zesch et al. ..... 112/102.5
6,832,841 B2 * 12/2004 Kitakata ..... 362/90
6,971,325 B1 * 12/2005 Inaba ..... 112/475.19
2007/0206371 A1 * 9/2007 Yamasaki ..... 362/90
2008/0035038 A1 * 2/2008 Ekholm et al. ..... 112/2

FOREIGN PATENT DOCUMENTS

JP 2004-141198 5/2004
JP 2005-58470 3/2005

* cited by examiner

*Primary Examiner*—Ismael Izaguirre
(74) *Attorney, Agent, or Firm*—McGinn Intellectual Property Law Group, PLLC

(57) ABSTRACT

A multi-needle type embroidery sewing machine includes a laser marker for irradiating a needle drop point of one of a plurality of needles attached to one of a plurality of needle bars being indexed to a sewing position with a laser beam. The laser marker is attached to an arm unit to be arranged just behind of the one of the plurality of needle bars indexed to the sewing position. The angle of inclination of the laser beam irradiating the needle drop point with respect to an axis of the one of the plurality of needle bars indexed to the sewing position is in a range of 5 degrees to 25 degrees.

20 Claims, 5 Drawing Sheets

MULTI-NEEDLE TYPE EMBROIDERY SEWING MACHINE

TECHNICAL FIELD

The present invention relates to a multi-needle type embroidery sewing machine provided with a laser marker.

BACKGROUND OF THE INVENTION

In the prior art, there is known a technique for determining an embroidery starting position of a workpiece in conformity with the indication of a laser beam emitted from a laser marker. In Japanese Patent Application Publication No. JP-A-2004-141, for example, as shown in FIG. 4, there is described a multi-needle type embroidery sewing machine, which is provided with a thread raising device 52 disposed below an arm unit 51 of a machine head 50 and sloped up backward, and a laser marker 53 attached in parallel with that inclination to the midway portion of the lower face of the thread raising device 52, so that a needle drop point 57 of a bed 56 is obliquely irradiated with a laser beam 54.

In Japanese Patent Application Publication No. JP-A-2005-58470, on the other hand, as shown in FIG. 5, there is described a multi-needle type embroidery sewing machine, in which the laser marker 53 is attached to a needle bar support 58 in place of some of a plurality of needle bars 55 and in which the needle bar support 58 is moved by a color changing mechanism thereby to index the laser marker 53 to just above the needle drop point 57.

SUMMARY OF THE INVENTION

According to the multi-needle type embroidery sewing machine of JP-A-2004-141, however, the laser marker 53 is attached to a position largely spaced backward from the needle bar 55 so that the laser beam 54 makes a large angle of inclination θ of 40 degrees or more with respect to the axis of the needle bar 55. This raises a drawback that the indication of the laser beam 54 irradiating the workpiece easily deviates from the needle drop point, and this deviation is the larger for the thicker workpiece. Moreover, the position, to which the laser marker 53 is attached and which is spaced backward from the needle bar 55, is just located at the position where a visor Wa is relieved in case the front face of a cap W is embroidered. As a result, the visor Wa may come into contact with the laser marker 53.

According to the multi-needle type embroidery sewing machine of JP-A-2005-58470, on the other hand, the laser beam 54 can be emitted from just above the needle drop point 57 so that the indication of the laser beam 54 does not deviate from the needle drop point. In case, however, the laser marker 53 is attached afterward to the existing embroidery sewing machine, the needle bar 55 has to be removed from the needle bar support 58. This necessity raises problems that the removal is troublesome and that the number of needle bars 55 is reduced.

An object of the present invention is to solve the problems thus far described, and to provide a multi-needle type embroidery sewing machine, to which the laser marker can be easily attached afterward without reducing the number of needles, and in which the indication of the laser beam to irradiate the workpiece is aligned, when used, with the needle drop point while preventing the laser marker from interfering with the visor or the like of the cap.

In order to solve the problems described above, a multi-needle type embroidery sewing machine according to the present invention comprises: a machine head which includes an arm unit, a needle bar support supported on the front face of the arm unit so as to be movable in a transverse direction, a plurality of needle bars supported by the needle bar support so as to be movable in a vertical direction, and needles individually attached to the needle bars, and is constituted such that the one needle bar is indexed to a sewing position by a movement of the needle bar support; and a laser marker for irradiating a needle drop point of the needle attached to the needle bar indexed to the sewing position, with a laser beam. The laser marker is attached to the arm unit so as to be arranged just behind of the needle bar indexed to the sewing position, and the angle of inclination of the laser beam with respect to the axis of the needle bar indexed to the sewing position is 5 degrees to 25 degrees.

Here, the needle bar support can be exemplified by a slide block capable of linearly moving in the transverse direction, a rotary block capable of turning in the transverse direction on a vertical axis, or the like. Moreover, the reason why the inclination angle of the laser beam with respect to the axis of the needle bar is set to 5 degrees to 25 degrees is described in the following. If the inclination angle exceeds 25 degrees, the irradiation point of the workpiece with the laser beam has a tendency to deviate from the needle drop point, and this deviation becomes the larger for the thicker workpiece. Therefore, this inclination angle is preferred to be smaller. If, however, the inclination angle is made less than 5 degrees, the laser marker comes excessively closer to the needle bar mover and the needle bar which move in the transverse direction at a position close to the arm unit, and therefore the laser marker may interfere them. It is more preferred that the inclination angle is within the range of 5 degrees to 20 degrees.

In order to attach the laser marker afterward more easily to the existing multi-needle type embroidery sewing machine, the preferred mode is that the laser marker is attached to the arm unit through a bracket. In the more preferable mode, the laser marker is attached to a marker attaching portion of the bracket, and an attachment portion of the bracket is attached to the left or right side position of the arm unit, which is exposed to the front when the needle bar support moves and deviates. In this case, the bracket is made transversely long so that the attachment portion of the bracket is positioned just behind the needle bar indexed to the sewing position.

In order to attach the laser marker easily at the aforementioned inclination angle, the preferred mode is that the bracket is attached to the position below the arm unit and higher than the needle at the position of a top dead point. This mode is exemplified such that the bracket is attached to the arm unit through a part (preferably, the existing part) fixed below the arm unit. This fixed part is preferably exemplified by the part arranged to confront the needle bar support, and a bracket is preferably attached to the front face of that part. The fixed part can be exemplified by a keep solenoid for driving the device (disposed on the needle bar support) which holds the needle thread on the side closer to the thread feed source than that needle.

The indication of the laser marker should not be limited to a specific pattern but can be exemplified by dots, a single line, cross lines or a curve. It is preferred for adjusting the indication position of the laser marker finely on the workpiece that the laser marker or the bracket is attached so that its position can be adjusted with respect to the arm unit. The preferred mode can be exemplified such that the bracket is attached to the arm unit so that the position of the bracket can be adjusted in the transverse direction with respect to the arm unit, and such that the laser marker is attached to the bracket so that an angle of the laser marker can be adjusted in the longitudinal direction with respect to the bracket.

According to the invention, there is attained an excellent effect, in which the laser marker can be easily attached afterward to the existing multi-needle type embroidery sewing machine without reducing the number of needles, and in which the indication of the laser beam to irradiate the workpiece is aligned, when used, with the needle drop point while preventing the laser marker from interfering with the visor or the like of the cap.

DESCRIPTION OF THE PREFERRED EMBODIMENT

Figure 1:
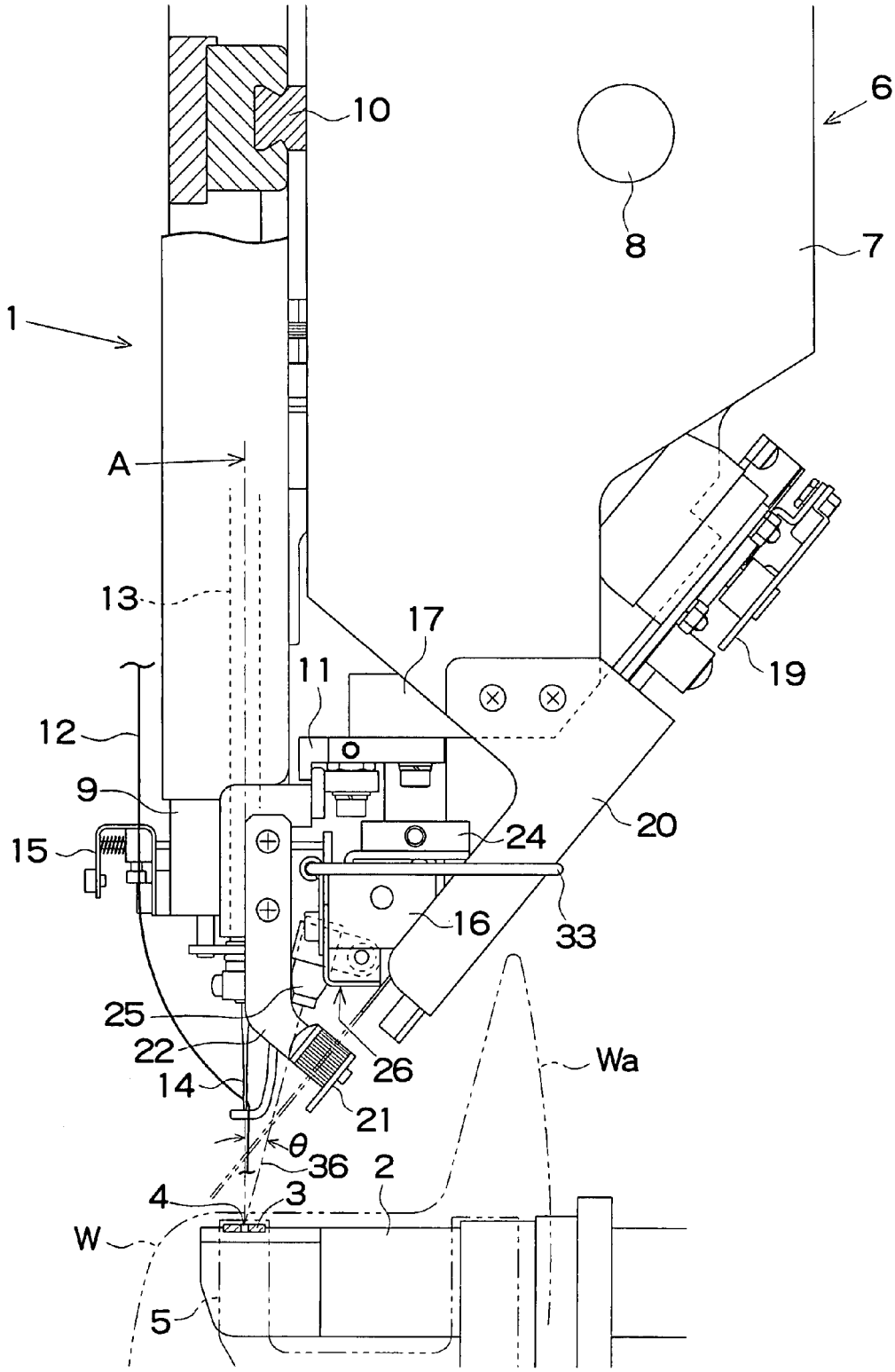
FIG. 1 is a side view showing an embroidery sewing machine of an embodiment according to the invention.

A machine head (6) includes an arm unit (7), a needle bar support (9) supported on the front face of the arm unit so as to be movable in a transverse direction, a plurality of needle bars (13) supported by the needle bar support so as to be movable in a vertical direction, and needles (14) individually attached to the needle bars, and is constituted such that the one needle bar (13) is indexed to a sewing position by a movement of the needle bar support (9). A laser marker (25) for irradiating a needle drop point of the needle (14) attached to the needle bar (13) indexed to the sewing position, with a laser beam (36), is attached to the arm unit (7) so as to be arranged just behind of the needle bar (13) indexed to the sewing position. The angle of inclination of the laser beam (36) with respect to the axis of the needle bar (13) indexed to the sewing position is 5 degrees to 25 degrees. The laser marker (25) is attached to a marker attaching portion of the bracket (26), and an attachment portion of the bracket (26) is attached to one of left and right side positions of the arm unit (7) which may be exposed to the front when the needle bar support (9) moves and deviates.

Figure 2:
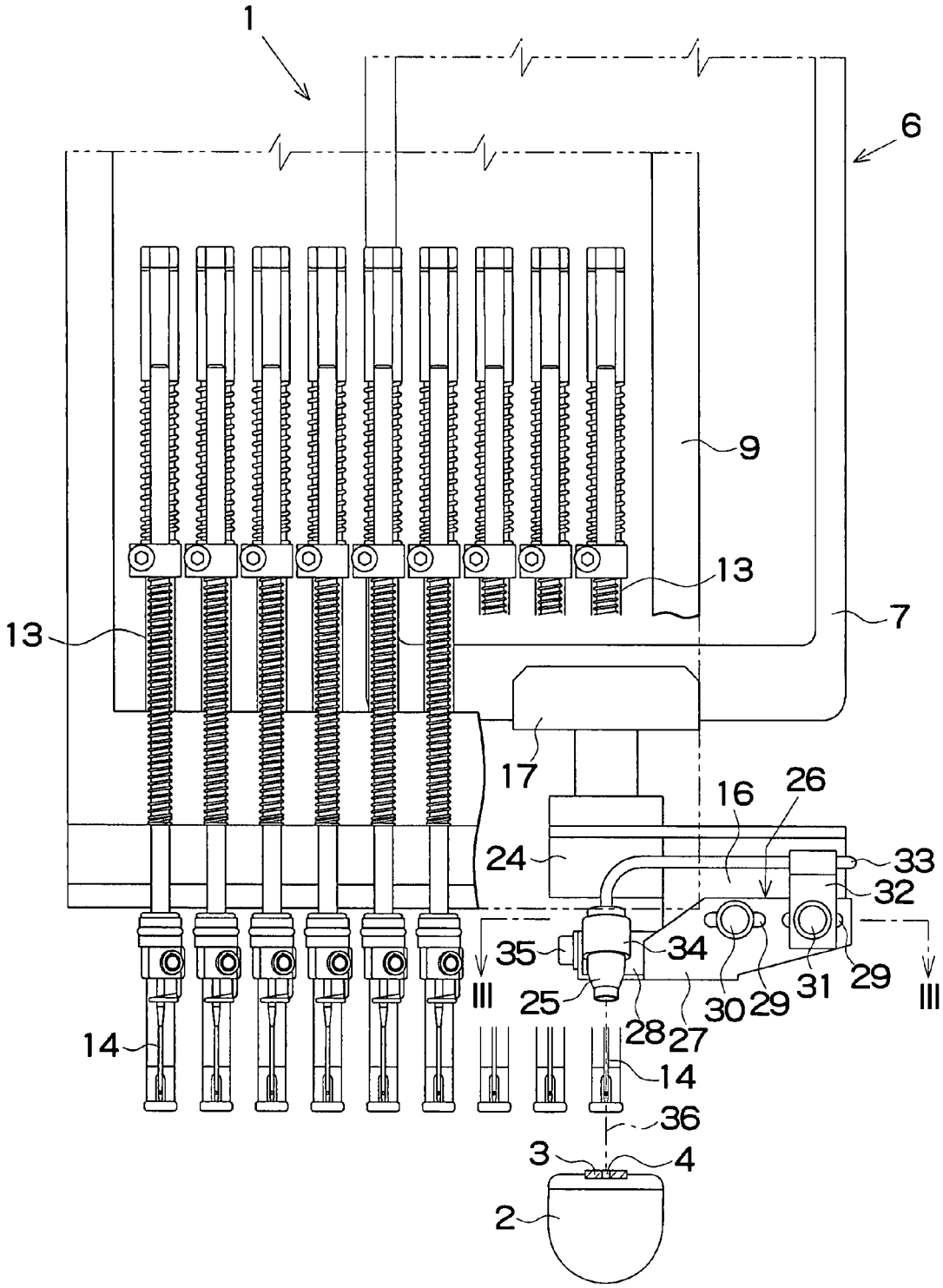
FIG. 2 is a front view of the same embroidery sewing machine.
Figure 3:
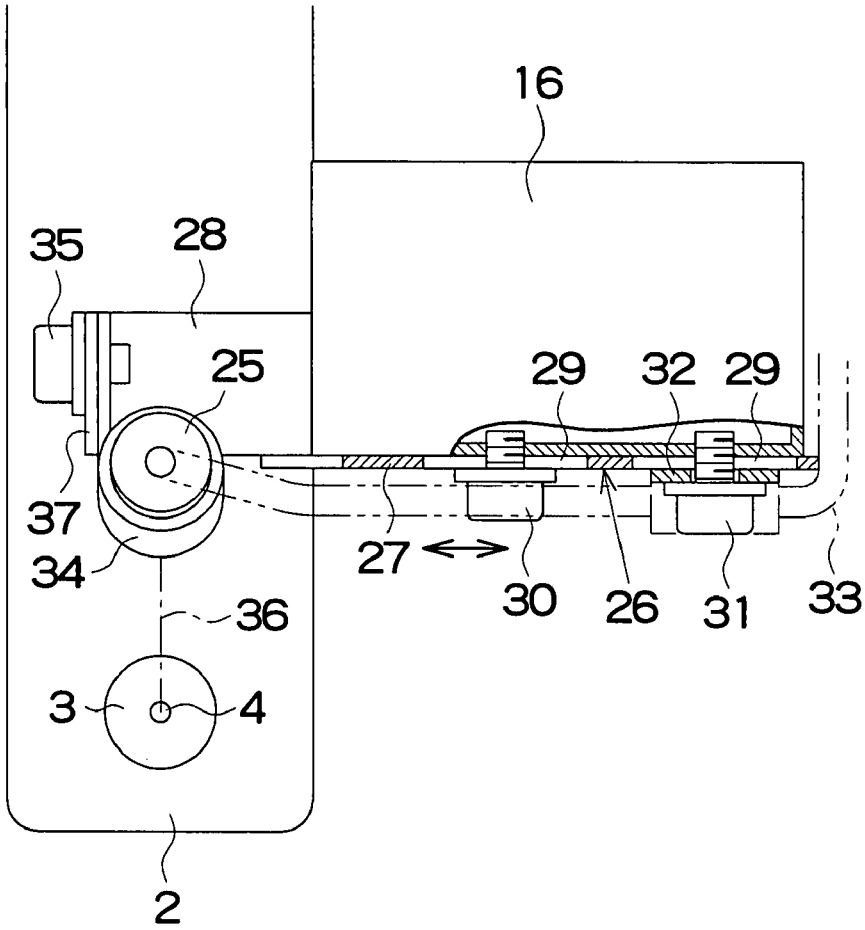
FIG. 3 is a sectional view along line III-III of FIG. 2.
Figure 4:
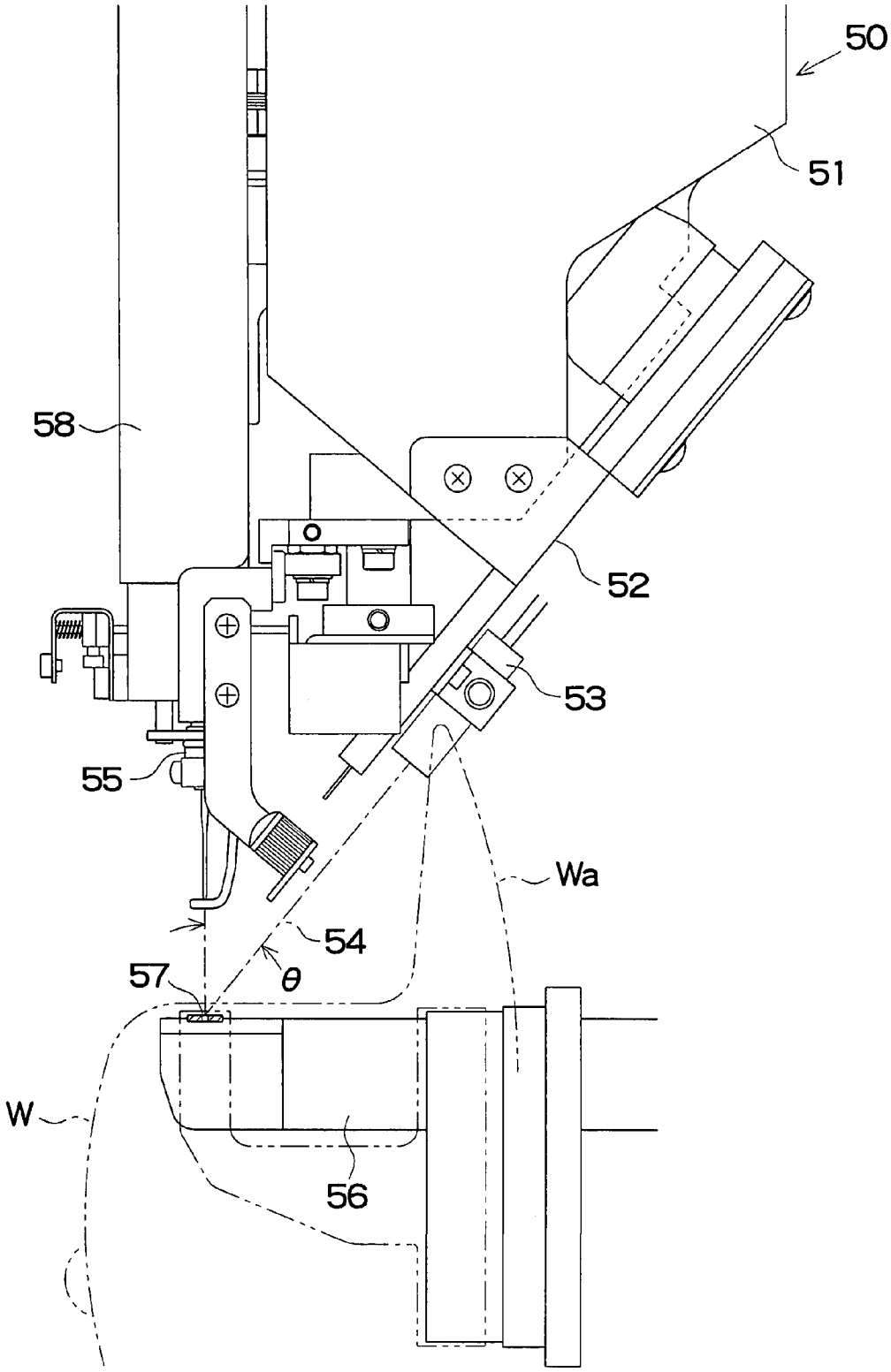
PRIOR ART FIG. 4
FIG. 4 is a side view showing an embroidery sewing machine of the prior art.
Figure 5:
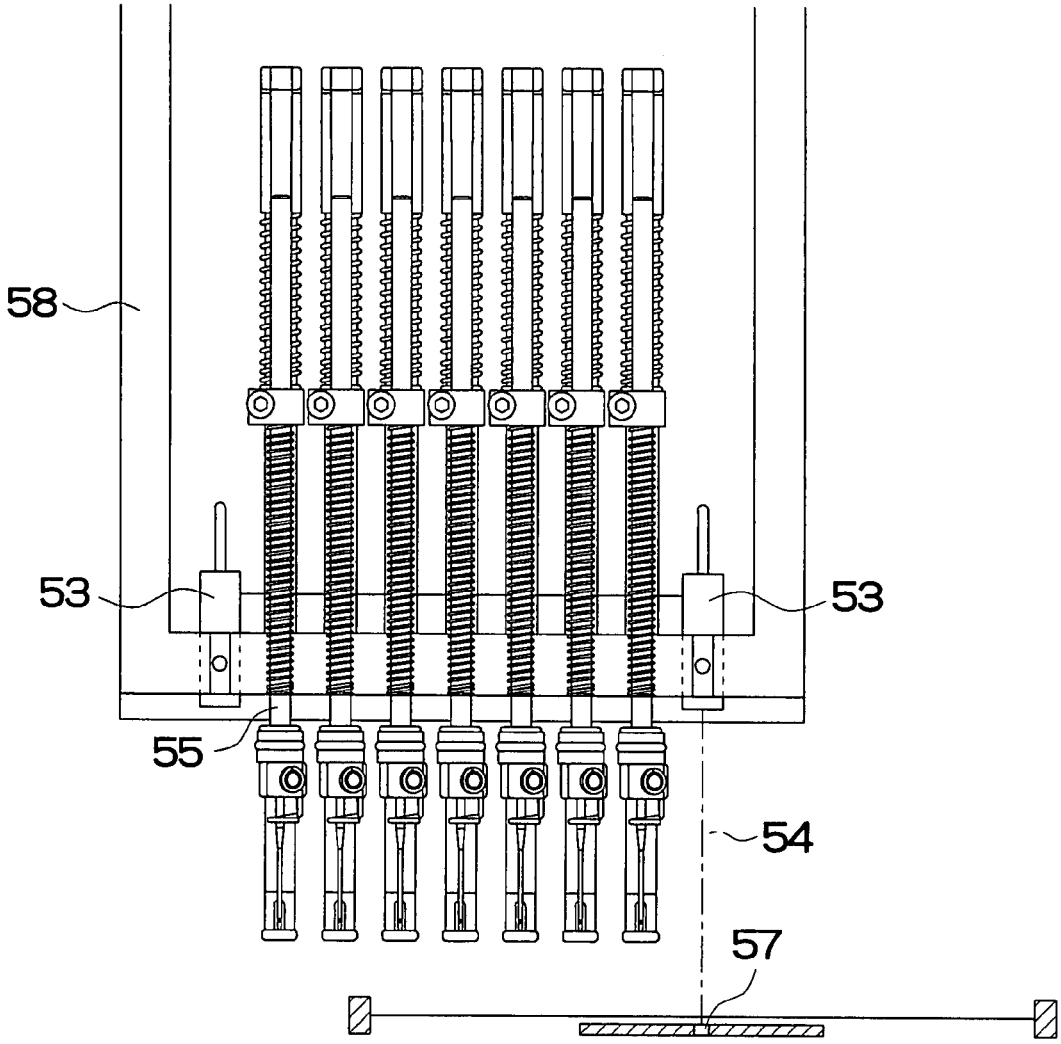
PRIOR ART FIG. 5
FIG. 5 is a front view showing another embroidery sewing machine of the prior art.

An embodiment of the invention will be described in the following with reference to FIG. 1 to FIG. 3. As shown in FIG. 1 and FIG. 2, a multi-needle type embroidery sewing machine 1 of this embodiment is provided with a bed 2 below the machine frame (not shown). A throat plate 3 is disposed on the upper face of the front end portion of the bed 2, and a needle hole 4 for determining a needle drop point is formed in the throat plate 3. Here, FIG. 1 shows a cap W as a completed work, and a cap frame 5 for holding the cap W over the throat plate 3.

A machine head 6 is disposed over the bed 2. The machine head 6 includes an arm unit 7 (or a transversely immovable head base), a slide block 9 acting as a needle bar support which is transversely slidably supported on the front face of the arm unit 7, a plurality of needle bars 13 which is vertically movably supported by the slide block 9, and needles 14 which are attached to the individual needle bars. The machine head 6 is constituted such that one needle bar 13 is indexed to a sewing position (i.e., a position just above a needle hole 4 and a transversely center position of the arm unit 7) by the movement of the slide block 9.

An arm shaft 8 extends through the arm unit 7, and the mechanism (not shown) for converting the rotations of the arm shaft 8 into vertical drives of the needle bar 13 indexed to the sewing portion is installed in the arm unit 7. The slide block 9 is supported at its upper portion by a rail 10 of the arm unit 7 and guided at its lower portion by a guide 11 of the arm unit 7, and is driven by the color changing mechanism (not-shown) of the multi-needle type embroidery sewing machine 1. On the front face of the slide block 9, there is disposed a thread holding device 15 for holding a needle thread 12 on the side closer to the thread feed source (or bobbin) than the needle 14. A keep solenoid 16 for driving the thread holding device 15 is fixed below the arm unit 7 at a position higher than the needle 14 at a top dead center, as shown in FIG. 1.

At the lower end of the arm unit 7, there is disposed a thread raising device 19 at a backward rising inclination. The thread raising device 19 relieves the end portion of the needle thread 12 after cut below the throat plate 3, backward of the vertical path of the needle 14. The thread raising device 19 is covered at its lower face with a cover 20 attached to the arm unit 7. To the lower end of the slide block 9, there is attached a thread guard 21 for holding the end portion of the needle thread 12 by a pair of left and right attaching members 22 so as to be positioned ahead of the thread raising device 19.

From the lower portion of the arm unit 7, an overhang 17 is protruded forward, and a mounting member 24 is assembled below the overhang 17. The mounting member 24 is protruded rightward from the transverse center portion of the arm unit 7, and the keep solenoid 16 is mounted on a portion positioned below the right end portion of the arm unit 7. When the slide block 9 is moved by the color changing function to the left end of the stroke so as to index the needle bar 13 on the right end to the sewing position, the slide block 9 leaves the right side position of the arm unit 7, so that the front face of the keep solenoid 16 at that right side position is exposed to the front.

In this embodiment, a laser marker 25 for irradiating the needle drop point of the needle 14 attached to the needle bar 13 indexed to the sewing position, with a laser beam is attached to the arm unit 7 so as to be arranged just behind of the needle bar 13 indexed to the sewing position. The laser beam 36 has its angle of backward inclination θ set to 10 degrees to 20 degrees with respect to the axis of the needle bar 13 indexed to the sewing position. As shown in FIG. 2 and FIG. 3, more specifically, the laser marker 25 is attached to the keep solenoid 16 through a bracket 26. The bracket 26 is elongated in the transverse direction, and is provided with an attachment portion 27 to be attached to the front face of the keep solenoid 16, and a marker attaching portion 28 protruded leftward of the keep solenoid 16. In the attachment portion 27, there are formed a pair of left and right slots 29. By screws 30 and 31 which are extended through the slots 29, the bracket 26 is attached to the keep solenoid 16 so that the position of the bracket 26 can be adjusted in the transverse direction. A cord fixer 32 is mounted on the front face of the attachment portion 27 by one screw 31, and a cord 33 of the laser marker 25 is fixed by the cord fixer 32.

The laser marker 25 is held by a holder 34, and the holder 34 is supported on a left end bent member 37 of the marker attaching portion 28 by a bolt 35 so as to be angularly adjusted in the longitudinal direction. The bent member 37 positions the holder 34 transversely centrally of the arm unit 7, and adjusts the bracket 26 finely in the transverse direction, so that the laser marker 25 is attached to the arm unit 7 so as to be arranged just behind the needle bar 13 indexed to the sewing position. By finely adjusting the angle of the holder 34, the inclination angle θ of the laser beam 36 is set to 10 degrees to 20 degrees, as described hereinbefore. Thus, the laser beam 36 irradiates the work W from the position as close to just above the needle hole 4 as possible.

According to the multi-needle type embroidery sewing machine 1 thus constituted, the slide block 9 deviates when moved, so that the front face of the keep solenoid 16 is exposed to the front. As a result, the laser marker 25 can be easily attached afterward to the narrow space between the arm unit 7 and the block 9. In the case of the shown embodiment, a needle number corresponding to the needle bar 13 of the ninth order from the left is inputted in the machine controller, the block 9 is moved to the stroke left end by the color changing mechanism, the screws 30 and 31 are fastened through the existing threaded holes to the keep solenoid 16, and then the bracket 26 of the laser marker 25 is attached. The number of needle bars 13 is not reduced even if the laser marker 25 is attached afterward.

Then, the cord 33 is connected with the power source unit of the multi-needle type embroidery sewing machine 1, the laser beam is emitted from the laser marker 25, and the transverse position and the longitudinal angle of the laser marker 25 are adjusted such that the mark of a dot or a line is indicated over the needle hole 4. The transverse positions are adjusted by loosening the screws 30 and 31 and by sliding the bracket 26 within the length range of the slots 29. The longitudinal angle can easily adjusted by loosening the bolt 35 and by turning the holder 34 on a horizontal axis (or around the bolt 35).

When the laser marker 25 is to be used, for example, the cap W is set on the cap frame 5, and the cap frame 5 is driven longitudinally and transversely (or in the circumferential direction of the cap frame 5) so that the mark of the laser marker 25 is aligned to the embroidery starting point of the cap W. Then, the multi-needle type embroidery sewing machine 1 is started, the contour tracing of an embroidery pattern is executed to confirm whether or not the needle 14 contacts with the cap frame 5 (i.e., the presence or absence of a frame hit). If there is a problem of the frame hit, the change in the embroidery starting point or in the applying position of the cap W is made based on the indication of the laser maker 25, and the embroidery working is then started.

The laser marker 25 emits the laser beam 36 from the position as close to just above the needle hole 4 as possible, and the laser beam 36 has the inclination angle θ as small as 10 degrees to 20 degrees. Therefore, even in case that the thickness of the work varies (0.5 mm to 4 mm, for example), the mark of the laser beam 36 can be substantially correctly aligned to the needle drop position. Moreover, the laser marker 25 is attached to the arm unit 7 so as to be arranged just after the needle bar 13 indexed to the sewing position, so that a visor Wa can be kept away from contact with the laser marker 25 while the cap W is being embroidered.

The invention should not be limited to the foregoing embodiment but can also be embodied by modifying it suitably within the following range but without departing from the gist thereof.

(1) The laser marker 25 is attached to either the arm unit 7 at the portion exposed as the slide block 9 moves to the stroke right end or the part fixed at the portion below the arm unit 7.

(2) In the embroidery sewing machine of the type in which the needle bar support rotates on the vertical axis, the laser marker is attached to either the arm unit at the portion exposed as the needle bar support rotates or a fixed part below the arm unit.

What is claimed is:

1. A multi-needle type embroidery sewing machine, comprising:

a machine head, comprising:

an arm unit;

a needle bar support supported on a front face of the arm unit to be movable in a transverse direction;

a plurality of needle bars supported by the needle bar support to be movable in a vertical direction, a needle bar of the plurality of needle bars being indexed to a sewing position by a movement of the needle bar support; and a plurality of needles individually attached to the plurality of needle bars; and a laser marker for irradiating a needle drop point of a needle of the plurality of needles attached to the needle bar being indexed to the sewing position with a laser beam, wherein the laser marker is attached to the arm unit to be arranged just behind of the needle bar indexed to the sewing position, and wherein an angle of inclination of the laser beam irradiating the needle drop point with respect to an axis of the needle bar indexed to the sewing position is in a range of 5 degrees to 25 degrees.

2. The multi-needle type embroidery sewing machine according to claim 1, wherein the laser marker is attached to the arm unit through a bracket.

3. The multi-needle type embroidery sewing machine according to claim 2, wherein the laser marker is attached to a marker attaching portion of the bracket, and wherein an attachment portion of the bracket is attached to one of left and right side positions of the arm unit that is exposed to a front portion of the multi-needle type embroidery sewing machine when the needle bar support moves and deviates.

4. The multi-needle type embroidery sewing machine according to claim 2, wherein the bracket is attached to a position below the arm unit and higher than the needle at a position of a top dead point.

5. The multi-needle type embroidery sewing machine according to claim 2, wherein the bracket is attached to the arm unit through a part fixed below the arm unit.

6. The multi-needle type embroidery sewing machine according to claim 5, wherein the fixed part comprises a keep solenoid for driving a device which holds a needle thread on a side closer to a thread feed source than the needle.

7. The multi-needle type embroidery sewing machine according to claim 2, wherein the bracket is attached to the arm unit so that a position of the bracket is adjustable in the transverse direction with respect to the arm unit.

8. The multi-needle type embroidery sewing machine according to claim 2, wherein the laser marker is attached to the bracket so that an angle of the laser marker is adjustable in a longitudinal direction with respect to the bracket.

9. The multi-needle type embroidery sewing machine according to claim 1, wherein the angle of inclination of the laser beam irradiating the needle drop point with respect to the axis of the needle bar indexed to the sewing position is in a range of 5 degrees to 20 degrees.

10. The multi-needle type embroidery sewing machine according to claim 1, wherein the angle of inclination of the laser beam irradiating the needle drop point with respect to the axis of the needle bar indexed to the sewing position is in a range of 10 degrees to 20 degrees.

11. The multi-needle type embroidery sewing machine according to claim 3, wherein the laser marker is held by a holder that is supported on a left end bent member of the marker attaching portion, the holder being angularly adjustable in a longitudinal direction.

12. The multi-needle type embroidery sewing machine according to claim 3, wherein, when the attachment portion is exposed to the front portion of the multi-needle type embroidery sewing machine when the needle bar support moves and deviates, the laser marker is exposed to the front portion of the multi-needle type embroidery sewing machine.

13. The multi-needle type embroidery sewing machine according to claim 11, wherein the angle of inclination is dependent upon the holder being angularly adjustable in the longitudinal direction.

14. A multi-needle type embroidery sewing machine, comprising:

a machine head, comprising:

an arm unit;

a needle bar support supported on a front face of the arm unit to be movable in a transverse direction;

a plurality of needle bars supported by the needle bar support to be movable in a vertical direction, a needle bar of the plurality of needle bars being indexed to a sewing position by a movement of the needle bar support; and a plurality of needles individually attached to the plurality of needle bars; and a laser marker that irradiates a needle drop point of a needle of the plurality of needles attached to the needle bar being indexed to the sewing position with a laser beam, the laser marker being attached to the arm unit through a bracket that is attached to the arm unit through a keep solenoid fixed below the arm unit, the keep solenoid driving a device that holds a needle thread closer to a thread feed source than to the needle.

15. The multi-needle type embroidery sewing machine according to claim 14, wherein the keep solenoid is attached to a position higher than the needle at a position of a top dead point.

16. The multi-needle type embroidery sewing machine according to claim 14, wherein the keep solenoid is mounted on a portion positioned below a right end portion of the arm unit.

17. The multi-needle type embroidery sewing machine according to claim 14, wherein the keep solenoid is attached to one of left and right side positions of the arm unit that is exposed to a front portion of the multi-needle type embroidery sewing machine when the needle bar support moves and deviates.

18. The multi-needle type embroidery sewing machine according to claim 14, wherein the laser marker is attached to the keep solenoid through the bracket.

19. The multi-needle type embroidery sewing machine according to claim 14, wherein the bracket comprises:

an attachment portion attached to a front face of the keep solenoid; and a marker attaching portion protruding to a left side of the keep solenoid, and wherein the bracket is attached to the keep solenoid such that a position of the bracket is adjustable in the transverse direction with respect to the arm unit.

20. The multi-needle type embroidery sewing machine according to claim 17, wherein, when the keep solenoid is exposed to the front portion of the multi-needle type embroidery sewing machine when the needle bar support moves and deviates, the laser marker is exposed to the front portion of the multi-needle type embroidery sewing machine.

* * * * *